US007021867B2

(12) United States Patent
Morizot

(10) Patent No.: US 7,021,867 B2
(45) Date of Patent: Apr. 4, 2006

(54) METHOD AND MACHINE FOR DYNAMIC GROUND COMPACTION

(75) Inventor: Jean-Claude Morizot, Paris (FR)

(73) Assignee: Freyssinet International (STUP), Cedex (FR)

( * ) Notice: Subject to any disclaimer, the term of this patent is extended or adjusted under 35 U.S.C. 154(b) by 0 days.

(21) Appl. No.: 10/489,036

(22) PCT Filed: Jan. 12, 2004

(86) PCT No.: PCT/EP2004/000669

§ 371 (c)(1),
(2), (4) Date: Oct. 12, 2004

(87) PCT Pub. No.: WO2005/068729

PCT Pub. Date: Jul. 28, 2005

(65) Prior Publication Data

US 2005/0152750 A1 Jul. 14, 2005

(51) Int. Cl.
*E02D 3/02* (2006.01)
*E02D 27/26* (2006.01)
*E66D 1/48* (2006.01)

(52) U.S. Cl. ..... 405/271; 405/258.1; 254/276; 404/133.05

(58) Field of Classification Search ..... 405/258.1, 405/271; 404/133.05, 133.2; 173/87, 84; 254/276

See application file for complete search history.

(56) References Cited

U.S. PATENT DOCUMENTS

| | | | | | |
|---|---|---|---|---|---|
| 4,002,211 | A * | 1/1977 | Holland | 173/87 |
| 4,260,281 | A * | 4/1981 | Sargent | 404/127 |
| 4,280,770 | A * | 7/1981 | Woodruff | 405/271 |
| 4,580,765 | A * | 4/1986 | Nicholson et al. | 254/276 |
| 5,244,311 | A * | 9/1993 | Galante | 404/133.05 |
| 6,505,998 | B1 * | 1/2003 | Bullivant | 405/271 |

FOREIGN PATENT DOCUMENTS

| | | | | |
|---|---|---|---|---|
| FR | 2635546 | * | 2/1990 | 405/271 |
| JP | 53 089216 | | 8/1981 | |
| JP | 63265013 | * | 11/1988 | 405/271 |
| JP | 01158107 | * | 6/1989 | 405/271 |
| WO | WO 99/09261 | | 2/1999 | |

OTHER PUBLICATIONS

Ryutaro Yoritomi, Patent abstracts of Japan, vol. 0082, No. 76, Dec. 18, 1984 & JP59145816.

Mitsuharu Nomura, Nippon Kokudo Kaihatsu, Patent abstracts of Japan, vol. 0051, No. 31, Aug. 21, 1981 & JP56067012.

* cited by examiner

*Primary Examiner*—Jong-Suk (James) Lee
(74) *Attorney, Agent, or Firm*—Banner & Witcoff, Ltd

(57) ABSTRACT

At least one cable is attached to a load lying on the ground via a releasable connection mechanism. A traction force is applied to the cable to hoist the load up to a prescribed height. That traction force is then eliminated or reduced to initiate a downward movement of the load followed by the cable. The connection mechanism is then released while the load is moving downwardly.

14 Claims, 4 Drawing Sheets

METHOD AND MACHINE FOR DYNAMIC GROUND COMPACTION

This application is a 371 national stage of PCT/EP04/00669 filed Jan. 12, 2004.

BACKGROUND OF THE INVENTION

The present invention relates to dynamic ground compaction techniques. These techniques are used to improve the structural characteristics of the ground, in particular prior to building construction works.

A dynamic compaction treatment densifies the ground down to great depths by means of very high energy waves. It involves heavy loads, typically from 10 to 100 tons, falling from a height of typically 10 to 40 meters. The layout of the impact points on the ground and the other parameters of the treatment (energies, phasing, rest periods) depend on the characteristics of the soil to be treated and possibly on measurement results obtained in a trial zone. These parameters are determined beforehand based on the desired ground characteristics.

Such ground treatment is frequently used for the foundation of buildings, or to stabilized large areas of embankment work or loose soil.

Two general types of dynamic ground compaction methods can be distinguished:

1) Method with Follower Cables.

Cable shovels used for dragline works are frequently equipped with winches having clutch means providing a so-called "free fall" function. Such machine can be used for dynamic ground compaction, by attaching the compaction load to one or more winch cables. After actuation of the winches to hoist the load up to the desired height, the clutches are released and the load falls, driving the cable and the winch drum behind it. After the impact, the winches are braked to stop their rotation, the cables are pulled again and a new cycle is resumed.

A shortcoming of that method is that, with the civil engineering machines available on the market, it is observed that the energy imparted to the ground on the impact is only 50 to 60% of the potential energy accumulated when hoisting the load. This low efficiency is due to frictional losses and to the inertia of the cables and winches. Such method can only be applied by using a single cable per winch (no multiplication of the winch effort) and a single cable layer on the winch drum. In practice, this limits the falling height to about 25 m and the compaction loads to about 25 tons. Accordingly, the unitary impact energy is at most 60%×25,000×9.81×25≈3,700 kJ.

2) Free Falling Method

To alleviate the poor falling efficiency of the above method, a possibility is to use a hoisting machine equipped with a connection device which can be released when loaded and which is interposed between the compaction load and the cables. Such connection device may be of the hook type, as used for towage. It can also be a specially-designed hydraulic clamp. The compaction load is hoisted up to the desired height where the winches are stopped, and then the hook or clamp releases the load which really falls freely.

The main advantage of that method is its high efficiency since the impact energy is equal to the potential energy produced by the hoisting action. In addition, it is possible to use reeving systems to multiply the traction force applied by the winches. It is also possible to use more than one cable layers on the winch drum. The impact energy is basically limited by the stability of the hoisting machine when loaded.

However, the method also has a number of drawbacks. When the connection means are released, the elastic energy built up within the machine and the cables when hoisting the load is suddenly transmitted to the connection device, mainly by the reaction of the cables. The mobile parts consisting of the connection device and possibly of the reeving system are kicked upwardly with a considerable energy. They can also be shoved laterally due to the dissymmetry of the system. Such reaction can cause various troubles, such as derailment of the cables, impacts on the crane structure, etc. The phenomenon has to be compensated for, either by increasing the weight of the moving parts up to about 20% of the weight of the release load, to the detriment of the overall efficiency, or by using external moors to limit the movements of the connection device.

In addition, the lowering of the connection device for reconnection to the load on the ground takes a significant amount of time, since it depends on the speed capacity of the unloaded winches, which is usually low. At best, a lowering time of the same order as the hoisting time can be expected. Therefore, this second method is relatively time-consuming.

An object of the present invention is to alleviate the above-commented drawbacks of the prior art.

SUMMARY OF THE INVENTION

The invention thus proposes a ground compaction method, comprising the steps of:

- attaching at least one cable to a load lying on the ground, via releasable connection means;
- applying a traction force to the cable to hoist the load up to a prescribed height;
- reducing said traction force to initiate a downward movement of the load followed by the cable; and
- releasing the connection means while the load is moving downwardly.

The hoisting is carried out by one or several winches of the "free falling" type (as in the prior methods with follower cable), with the possible use of pulley blocks to multiple the winch effort. The compaction load is hanged to the lower block or directly to the winch cables via releasable connection means, for example of the hook or clamp type. The connection means are released once they have reached a certain downward velocity, so that the connection part which remains attached to the cable is not thrown upwardly. This avoids damages to the structure, without requiring external mooring systems. In addition, the downward velocity of the connection means and the cable when the load is released reduces the time necessary to bring the connection means back into position on the load, after it has landed on the ground.

Another aspect of the present invention relates to a ground compaction machine, comprising a crane boom, winch means, at least one cable extending from the winch means around a deviation pulley on top of the crane boom, releasable connection means for connecting the cable to a load, and control means for actuating the winch means to hoist the load from the ground up to a prescribed height, reducing a traction force applied by the winch means to initiate a downward movement of the load followed by the cable, and releasing the connection means while the load is moving downwardly.

BRIEF DESCRIPTION THE DRAWINGS

DESCRIPTION OF PREFERRED EMBODIMENTS

Figure 1:
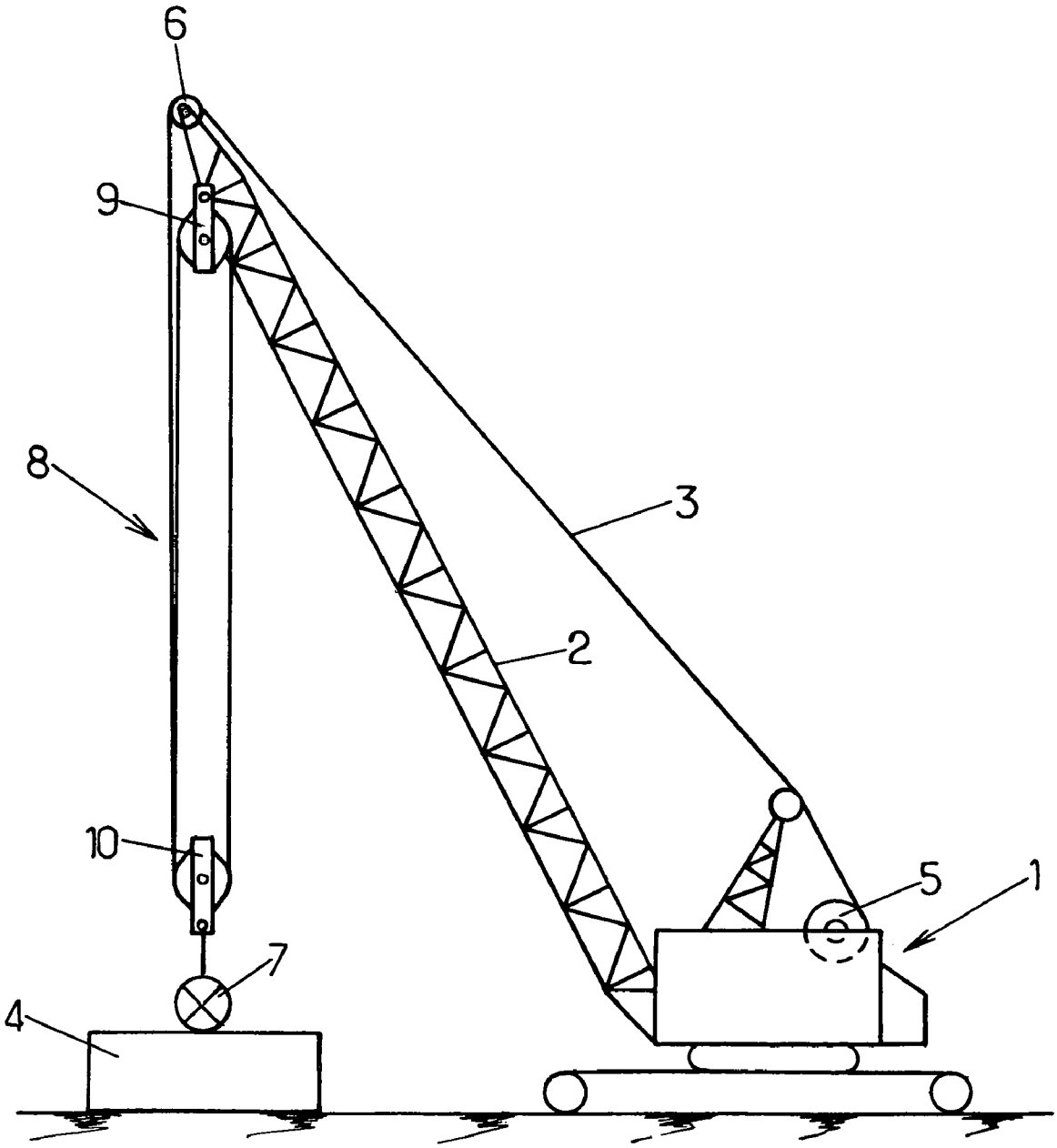
FIGS. 1 through 4 are schematic elevation views of a dynamic ground compaction machine at different steps of a method in accordance with the invention.

The ground compaction machine shown in FIGS. 1–4 has a vehicle structure 1 supporting a crane boom 2. One or more cables 3 are used to hoist a heavy load 4 (>10 tons) from the ground level to a predetermined dropping level H0 (>10 m). Each hoisting cable 3 is wound on the drum of a winch 5 mounted on the structure 1, and deviated by a pulley 6 on top of the crane boom 2.

A releasable connection device 7, schematically shown in FIGS. 1–4, is interposed between the hoisting cable(s) 3 and the compaction load 4.

In the embodiment illustrated by FIGS. 1–4, the machine further includes a reeving system 8 which receives the hoisting cable 3 between the deviation pulley 6 and the releasable connection device 7. Such system 8 may include an upper pulley block 9 mounted near the top of the crane boom 2 and a lower pulley block 10 whose frame is connected to the connection device 7. The cable 3 is received by the pulleys of blocks 9, 10 in order to multiple the hoisting effort applied by the winch 5.

It will be appreciated that, in other embodiments of the invention, the hoisting cable 3 may be directly attached to the releasable connection device 7.

Figure 5:
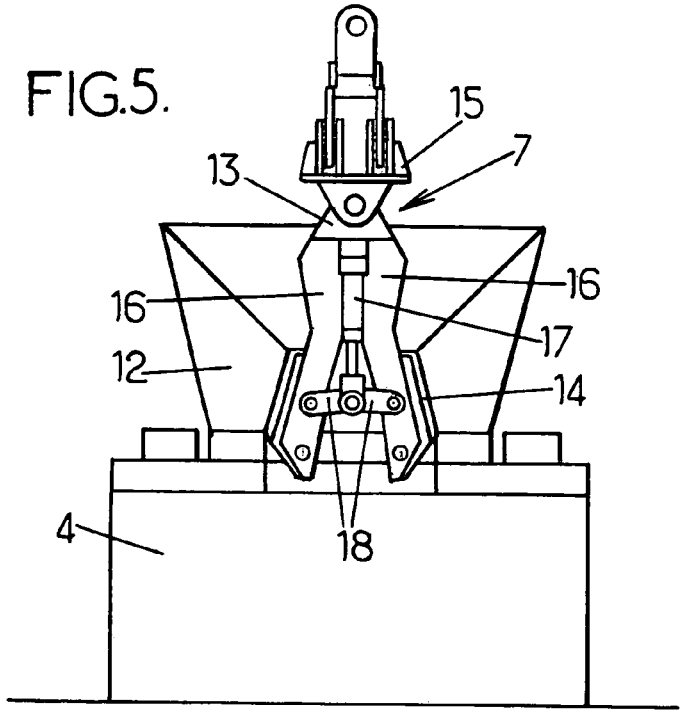
FIG. 5 is a schematic view of an example of releasable connection means usable in such machine.
Figure 4:
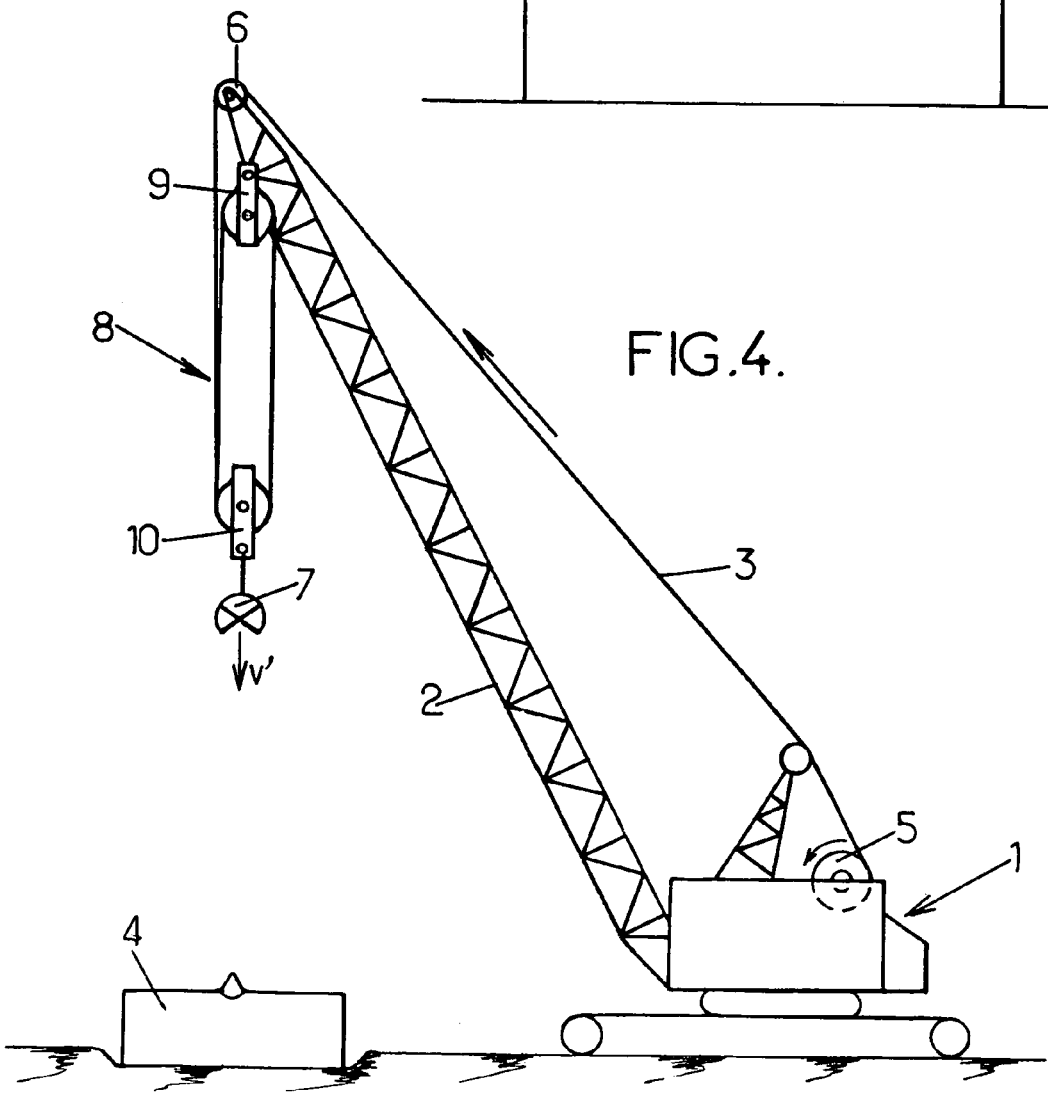

An exemplary embodiment of the releasable connection device is illustrated in FIG. 5. In that embodiment, the upper surface of the compaction load is fitted with a socket 12 adapted to receive a hydraulic clamp 13. The socket 12 has a wide central aperture having an upper conical portion which tapers outwardly towards the upper surface in order to center the clamp 13 as it is lowered in order to correctly position it within the socket. In the lower part of the socket 12, its central aperture widens to define a recess 14 suitable to receive the clamp 13.

The clamp 13 has a bracket 15 for connection to the lower pulley block 10 of the reeving system 8 (or directly to the cable 3). A plurality of jaw members 16 and articulated on the lower part of the bracket 15. These jaw members 16 are symmetrically arranged about a vertical axis. In their lower part, their external shape is conical to match that of the recess 14 provided in the socket 12. Each pair of opposing jaw members 16 is actuated by a hydraulic jack 17 via a lever mechanism. That mechanism includes a pair of rods 18 each articulated at its outer end on one of the jaw members 16 about a horizontal axis. The two rods 18 are also articulated together about a horizontal axis which crosses the vertical symmetry axis of the device 7. The jack 17 is disposed vertically. Its expansion lowers the articulation point between the two rods 18, thus moving the jaw members 16 away from each other into a clamping position in which they are pressed against the socket 12 within the recess 14. The retraction of the jack 17 lifts the articulation point between the two rods 18, bringing the jaw members 16 closer to each other to release the connection by allowing separation between the clamp 13 and the socket 12.

The jack 17 of the releasable clamp 13 is driven by a control unit (not shown) in order to provide the operation sequence described hereunder, in cooperation with the winch 5.

Once the pattern of the impacts on the ground and the sequence of impacts have been determined, the machine and the load 4 are brought to a first position. The clamp 13 is lowered and controlled to grip the load 4 lying on the ground, as shown in FIG. 1. The winch 5 is then energized so as to hoist the load 4 up to the predetermined height H0 as shown in FIG. 2.

At that moment, an important potential energy M×g×H0 has a build up, where M represents the weight of load 4. Ideally, 100% of that potential energy would be transmitted to the ground when dropping the load. Moreover, in the position in FIG. 2, a significant elastic energy has been accumulated in the hoisting cable 3 and in the structure of the machine, in particular in the crane boom 2.

Figure 2:
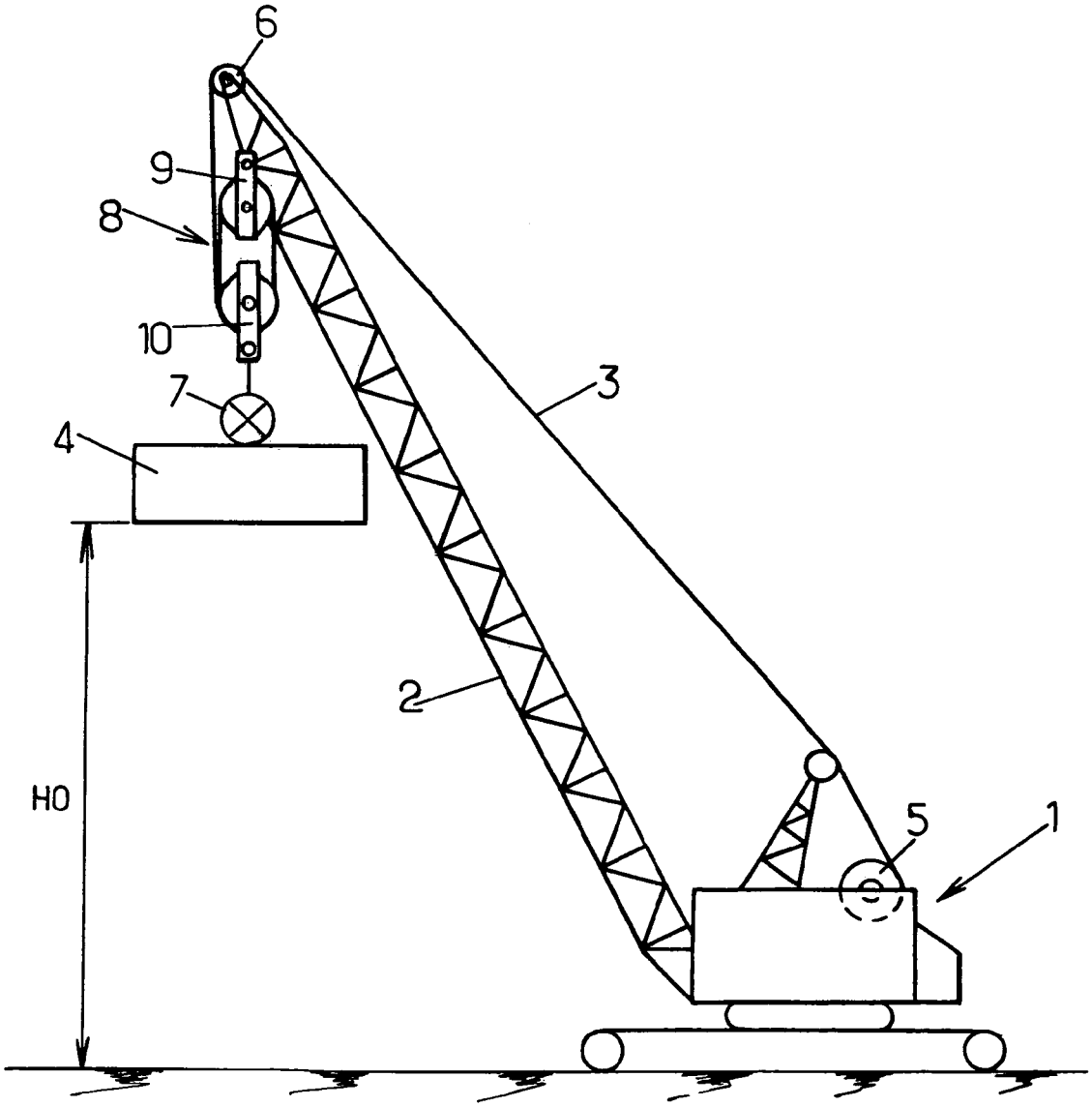

The downward movement of the load from the position shown in FIG. 2 is carried out in two phases.

Figure 3:
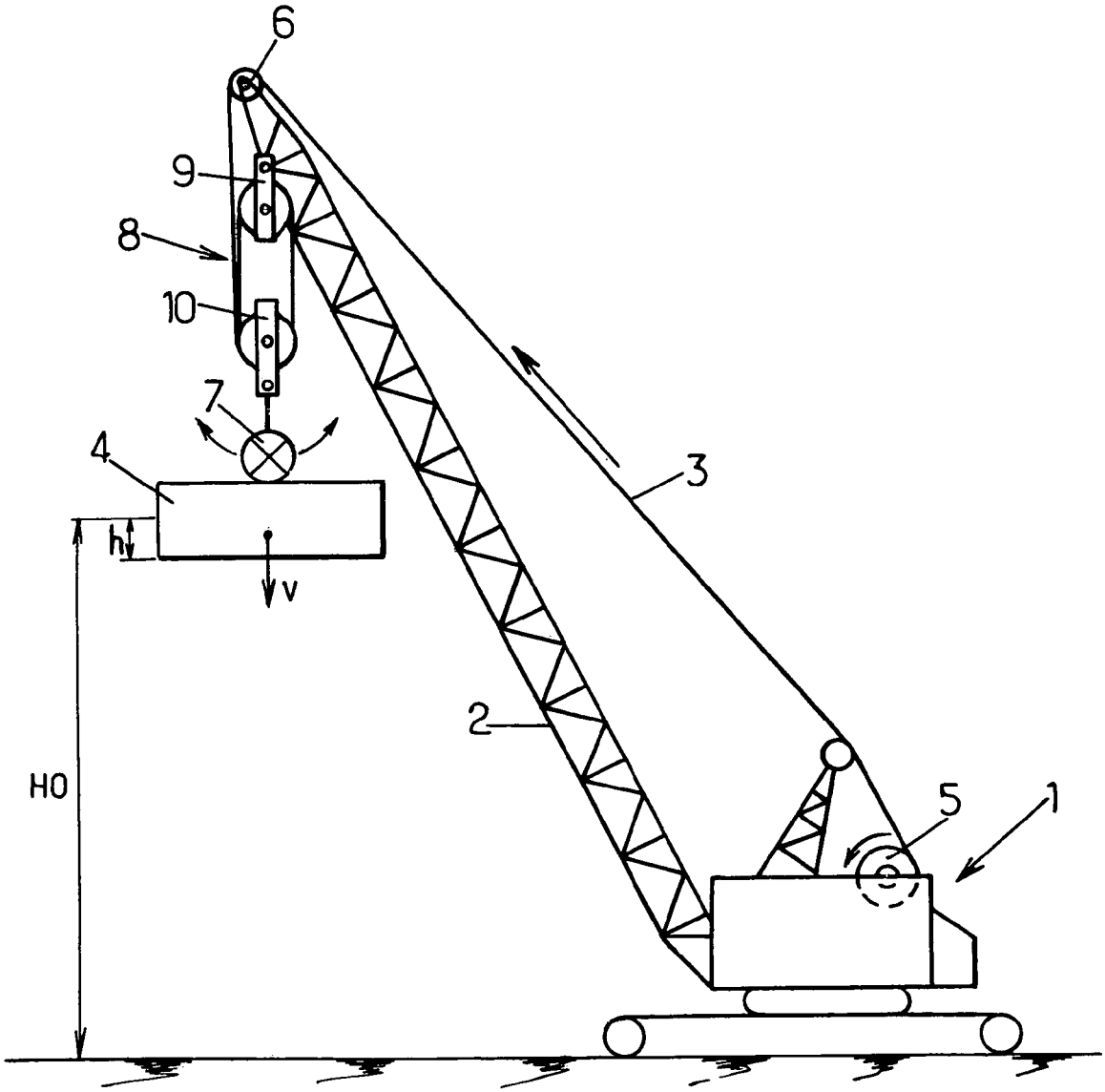

In the first phase, the winch 5 is controlled so that its drum is allowed to unwind, and the clamp 13 is not yet released. This eliminates or strongly reduces the traction force applied by the winch 5. The first phase is carried out until the load 4 has reached a certain downward velocity v, as shown in FIG. 3. At that moment, the second phase is initiated by releasing the clamp 13, thus allowing the load 4 to freely fall down to the ground.

Since the load 4 and the clamp 13 already have a certain velocity v when the clamp is released, the clamp 13 and the lower part 10 of the reeving system 8 are not kicked upwardly by the sudden release of the elastic energy accumulated in the cable 3 and the crane boom 2. This avoids the drawbacks of the previously known free falling methods.

In the second phase, the rotation of the winch drum 5 is braked by suitable clutch means (not shown) in order to control the downward velocity v' of the connection device 7 as it is lowered towards the load 4. This makes it possible to adjust the time necessary to reconnect the clamp 13 to the load 4, and thus to optimize the cycle time.

Once the clamp 13 has been reconnected, another cycle can be carried out, at the same position on the ground or after moving the machine and the load laterally.

There are various ways for the control unit to determine when the clamp 13 should be released once the downward movement of the load has been initiated.

In a simple embodiment, the connection device 7 is released (e.g. by retracting the hydraulic 17 shown in FIG. 5) a predetermined time t after the winch drum 5 has been allowed to unwind.

Alternatively, the connection device may be fitted with a position sensor. The device 7 is then released once it has traveled down a certain distance h (or equivalently once it has reached the height H0–h).

In another alternative, the connection device 7 is fitted with a speed sensor which monitors the falling speed of the load in the first phase. The release condition is then that the sensed falling speed reaches the predetermined threshold v, the jack 17 being retracted in response to the detection of that condition by the control unit.

Typical orders of magnitude for the above-mentioned thresholds are t≈0.5 s, h≈1 m, v≈4 m/s. Since the hoisting height H0 is usually more than 10 meters (e.g. H0=25 m), it is seen that the compaction load 4 does not lose more than a few percents of its potential energy in the first phase of the cycle, in which it also acquires a certain downward velocity v. Therefore, the overall energy transmitted to the ground at the impact will be very close to the initial potential energy. This means that the efficiency of the method is quite important, the inertia of the winch and of the structure being only undergone in the short first phase.

Such high efficiency is achieved without jeopardizing the structure by kicking up the clamp 13, the cable and the pulley block 10 when the load 4 is dropped, and with a relatively small cycle time.

What is claimed is:

1. A ground compaction method, comprising the steps of:

attaching at least one cable to a load lying on the ground by a releasable connection mechanism;

applying a traction force to the cable to hoist the load up to a prescribed height;

reducing said traction force to initiate and conduct a downward movement of the load and the cable attached to the load; and subsequent releasing the connection mechanism while the load and the cable are moving downwardly for freefall of the load.

2. The method as claimed in claim 1, wherein the cable extends around a deviation pulley on top of a crane boom, between the releasable connection mechanism and a winch used to apply the traction force.

3. The method as claimed in claim 2, further comprising the step of braking the cable at the winch once the connection mechanism has been released, to control downward movement of a portion of the connection mechanism which remains connected to the cable.

4. The method as claimed in claim 2, wherein the cable further extends through a reeving system between the deviation pulley and the releasable connection mechanism.

5. The method as claimed in claim 1, wherein the connection mechanism is released a predetermined time after the initiation of the downward movement.

6. The method as claimed in claim 1, wherein the connection mechanism is released in response to detection of a condition that a falling speed of the load reaches a predetermined threshold.

7. The method as claimed in claim 1, wherein the connection mechanism is released in response to detection of a condition that the load is at a specified height.

8. The method as claimed in claim 1, wherein the load has a weight of at least 10 tons, and said specified height is at least 10 meters.

9. A ground compaction machine, comprising:

a crane boom having a top;

winch means;

at least one cable extending from the winch means around a deviation pulley on top of the crane boom;

releasable connection means for connecting the cable to a load for compaction; and control means for actuating the winch means to hoist the load from the ground upwardly to a prescribed first height, reducing a traction force applied by the winch means to initiate and conduct a downward movement of the load and connected cable and releasing the connection means from the load while the load and the cable are moving downwardly.

10. The machine as claimed in claim 9, further comprising a brake cooperating with the winch means, actuated by the control means to brake the cable once the connection means has been released, to control downward movement of a portion of the connection means which remains connected to the cable.

11. The machine as claimed in claim 9, further comprising a reeving system receiving the cable between the deviation pulley and the releasable connection means.

12. The machine as claimed in claim 9, wherein the load has a weight of at least 10 tons, and the top of the crane boom is at least 10 meters above the ground.

13. A ground compaction method comprising the steps of attaching a cable to a compaction load;

elevating the compaction load to a first height by applying a lifting force to the cable;

subsequently reducing the lifting force on the cable and lowering the cable and compaction load to a second height lower than the first height; and thereafter disconnecting the cable from the compaction load as the cable and compaction load move downwardly.

14. A ground compaction machine comprising, in combination:

a boom having a cable;

a cable lifting mechanism connected to the cable for raising the cable and a load thereon;

a releasable connection device for attachment to a compaction load supported by the cable; and a control means for actuating the lifting mechanism to raise the cable and an attached load to a first height, for subsequently releasing the lifting mechanism to initiate lowering of the cable and attached load downwardly to a second lower height, and to then release the load from the connection device and cable while the load and the cable are moving downwardly.

* * * * *